US009622560B2

(12) United States Patent
Papas

(10) Patent No.: US 9,622,560 B2
(45) Date of Patent: Apr. 18, 2017

(54) DEVICE FOR ATTACHING PARCEL TO ROLLING SUITCASE

(71) Applicant: Demi Innovations, Billerica, MA (US)

(72) Inventor: Demetra Triantafyllos Papas, Billerica, MA (US)

(73) Assignee: Demi Innovations, Billerica, MA (US)

( * ) Notice: Subject to any disclaimer, the term of this patent is extended or adjusted under 35 U.S.C. 154(b) by 112 days.

(21) Appl. No.: 13/897,382

(22) Filed: May 18, 2013

(65) Prior Publication Data

US 2013/0341371 A1 Dec. 26, 2013

Related U.S. Application Data

(60) Provisional application No. 61/662,974, filed on Jun. 22, 2012.

(51) Int. Cl.
*A45C 13/00* (2006.01)
*A45C 13/30* (2006.01)

(52) U.S. Cl.
CPC ..... *A45C 13/30* (2013.01); *A45C 13/001* (2013.01); *A45C 2013/306* (2013.01)

(58) Field of Classification Search
CPC ..... A45C 3/02; A45C 7/0045; A45C 3/004; A45C 5/00
USPC ..... 190/100–115; 224/153, 572, 578, 585; 24/300, 362
See application file for complete search history.

(56) References Cited

U.S. PATENT DOCUMENTS

| | | | | |
|---|---|---|---|---|
| 4,673,070 | A | 6/1987 | Ambal | |
| 4,836,343 | A | 6/1989 | Arney | |
| 5,311,972 | A | 5/1994 | Plath | |
| 5,582,337 | A * | 12/1996 | McPherson | A45F 3/14 224/660 |
| 5,671,832 | A | 9/1997 | London et al. | |
| 5,713,439 | A | 2/1998 | Zionts et al. | |
| 5,788,032 | A * | 8/1998 | Krulik | A45C 3/02 150/107 |
| 5,829,559 | A | 11/1998 | Nordstrom et al. | |
| 6,152,342 | A * | 11/2000 | Suk | A63B 55/408 224/259 |
| 6,772,485 | B2 * | 8/2004 | Alpert | A45C 13/30 190/102 |
| 7,841,453 | B2 * | 11/2010 | Gold | A45C 13/30 190/102 |
| 7,918,502 | B2 | 4/2011 | Bacon | |
| 2005/0082131 | A1 * | 4/2005 | Fenton | A45C 5/14 190/108 |

(Continued)

*Primary Examiner* — Fenn Mathew
*Assistant Examiner* — Cynthia Collado
(74) *Attorney, Agent, or Firm* — Finch & Maloney PLLC

(57) ABSTRACT

A strap mechanism for attaching an additional parcel to a rolling suitcase is disclosed. A strip of elasticized material with a sleeve for sliding over a rolling suitcase handle is secured around the parcel using a hook and loop fastening mechanism. The strap mechanism prevents the additional parcel from twisting off or otherwise falling off of the rolling suitcase. A horizontally and vertically oriented device is presented, as well as a universal configuration. Different materials can be used for the strap mechanism including but not limited to neoprene, veltex, elastic, or medical grade elastic. Additional embodiments include the use of a pocket attached to a side of the strap which may be used for additional storage purposes.

12 Claims, 6 Drawing Sheets

(56) References Cited

U.S. PATENT DOCUMENTS

2006/0266603 A1* 11/2006 Godshaw ..... A45C 3/004
190/108

* cited by examiner

DEVICE FOR ATTACHING PARCEL TO ROLLING SUITCASE

RELATED APPLICATIONS

This application claims the benefit of the filing date of earlier filed U.S. Provisional Patent Application having Ser. No. 61/662,974, filed Jun. 22, 2012, and entitled "Device for Attaching Parcel to Rolling Suitcase," the entire teachings and contents of which are incorporated by reference herein in its entirety.

FIELD OF THE INVENTION

The invention relates to the field of luggage accessories and, more particularly, attachment methods for transporting multiple types of luggage parcels.

BACKGROUND

Attempts have been made in the past to secure additional bags to rolling luggage for the purpose of convenience when traveling with multiple bags. Attachment means have included straps, buttons, clips, buckles, notches, hooks, loops, mated releasable assemblies, and mesh webbing.

Gold et al U.S. Pat. No. 7,841,453 describes a rolling piece of luggage with an additional parcel of luggage strapped to retractable handle using a mechanism of loops and buckles. A fixed loop slides around the retractable handle of the rolling suitcase and an adjustable loop of thin strap material with buckle closure surrounds the second bag. The adjustable loop intended to secure the second bag provides no support for lateral movement should the operator of the rolling suitcase turn a sharp corner or otherwise make a sudden movement.

Bacon et al U.S. Pat. No. 7,918,502 provides an open space in a sheet of material for slipping over a retractable suitcase handle and a strap mechanism for supporting a child car seat against a rolling suitcase.

Arney U.S. Pat. No. 4,836,343 describes a Velcro, or hook and loop, fastening means and use of a flap to slidably attach one piece of luggage to another. The Velcro fastening mechanism surrounds each individual parcel of luggage and then a buckle attachment means secures one parcel to another.

In Nordstrom et al U.S. Pat. No. 5,829,559 discloses using a clasp to attach a strap to the retractable handle of the rolling suitcase and another clasp to attach the strap to the additional piece of luggage. Nordstrom discloses using tongue and slot means for securing the clasp mechanism. The additional piece of luggage is not seated securely at the top of the rolling suitcase and could easily slide from side to side during sudden movements or sharp turns.

Zionts et al U.S. Pat. No. 5,713,439 discloses the use of hooks, loops, and straps to attach an auxiliary bag to a rolling suitcase in which the auxiliary bag hangs from the front end of the rolling luggage and could easily slide from side to side during sudden movements or sharp turns.

Plath U.S. Pat. No. 5,311,972 describes a button attachment with hook for attaching a parcel of luggage to a rolling suitcase. The device requires a stud to be built in to the rolling suitcase to support the mechanism, therefore rendering it an attachment device that is not universal for all rolling suitcases.

Ambal U.S. Pat. No. 4,673,070 presents a mechanism for attaching two pieces of luggage in a side by side abutting manner. A plate is secured to each piece of luggage, one male and one female with a tongue and groove attachment mechanism, one slidably connectable to the other. Connecting the two pieces of luggage requires that the attachment plates are properly secured to the two pieces of luggage by screws. This is a somewhat timely process for simply securing one piece of luggage to the other.

In London et al U.S. Pat. No. 5,671,832, a girdle strap, which uses elastic material and a releasable fastener mechanism for attaching the free ends together, is used to secure a piece of luggage to a rolling piece of luggage. The girdle strap additionally uses a buckle mechanism for supporting the extra piece of luggage.

A mechanism for reliably harnessing an additional parcel of luggage to a rolling suitcase to prevent side to side movement without cumbersome straps and attachment means was not found in the prior art. Further, the present invention offers the flexibility of harnessing in a vertical or horizontal orientation such that the dimensions and size of the additional parcel to be transported would not be limited in either dimension.

SUMMARY OF THE INVENTION

The present invention provides a simple, unique mechanism to hug an extra bag or parcel securely to a rolling suitcase preventing slipping or swinging from side to side. The device allows the user to carry a wide variety of additional luggage on top of a rolling suitcase comfortably and with great ease of use.

After the retractable handle of a rolling suitcase is extended, the attachment device sleeve is slid over the retractable handle. The bag or parcel to be carried is placed on top of the suitcase adjacent to the retractable handle. The bag or parcel is wrapped with the attachment device and secured using the hook and loop fastening mechanism.

Alternatively, the bag or parcel is wrapped snugly with the attachment device and secured with the hook and loop fastening mechanism prior to sliding the sleeve opening over the retractable handle of the rolling suitcase.

A vertical and horizontal style will be available to accommodate bags of different sizes and shapes, as well as a universal style that is interchangeable between the vertical and horizontal orientation. The vertical and horizontal oriented attachment device, as well as the universal style, can accommodate gym bags, duffel bags, shopping bags, purses, carry-on bags, boxy items, purses, or any other item that could reasonably fit on top of a rolling suitcase. The handle of a bag or purse can be looped around the rolling suitcase handle for extra support.

The attachment device can be made with a slight stretch material. Different materials can be used for the strap mechanism including neoprene, veltex, elastic, medical grade elastic, stretch jean material, necked-bonded laminate (NBL), stretch-bonded laminate (SBL), or any other related material and also including any material that would be obvious to one of ordinary skill in the art.

The strap mechanism can have one side that is receptive to a hook and loop fastening mechanism, such as Velcro. A Velcro strip will be secured to the end of the other side. Alternatively, in the case where the material used for the strap mechanism does not have any Velcro receptive area, a Velcro strip can be placed on the outside surface of the strap mechanism for securing the strap mechanism in place using the Velcro strip.

A sleeve will be located either in the center of the length of the strap or off center. An off center configuration would provide flexibility depending on the length of the strap mechanism to ensure that the Velcro attachment strip can be secured roughly at the front center of the additional parcel to be transported. The sleeve can either be placed on the outside or inside surface of the strap mechanism depending on the configuration (vertical, horizontal, or universal).

An additional pocket can be optionally attached to a side of the strap for storage of a cell phone, PDA, tablet, MP3 player, keys, pens or pencils, passports or other travel paperwork, or any other item of an appropriate size. The pocket may be detachable or permanently attached to the device. In the case of a detachable pocket, the pocket may be secured using a hook and loop fastening mechanism or by any other means that would be obvious to one of ordinary skill in the art.

DETAILED DESCRIPTION OF THE INVENTION

Figure 1A:
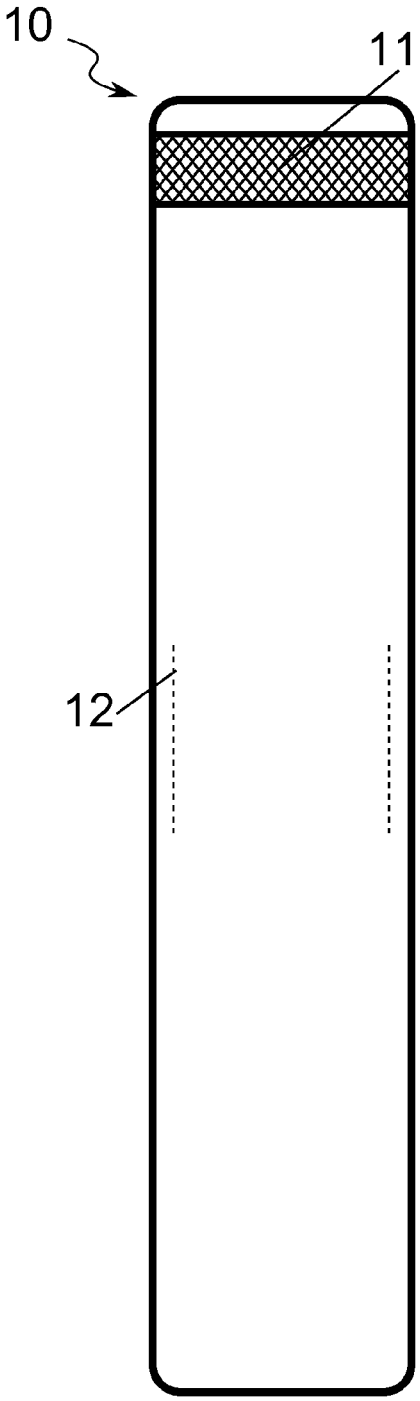
FIG. 1*a* shows the inside surface of the vertical orientation of the device for attaching an additional parcel to a rolling suitcase.

Referring now to the drawings, wherein like or corresponding reference numerals are used for like or corresponding parts throughout the several views, FIG. 1*a* is an illustration of one embodiment of the device for attaching a parcel to a rolling suitcase laid out in a flat configuration. This figure illustrates the device in the vertical orientation. In this configuration, an elongated bag or parcel could be placed on top of a rolling suitcase with the device wrapped around the top, bottom, and front and back sides of the parcel. Strip 11 consists of a hook and loop fastening mechanism, such as Velcro, and is used to secure the device 10 around an additional parcel. Strip 11 can either attach to Velcro receptive area 13 or another strip of Velcro on the outside surface of the strap mechanism.

Figure 1B:
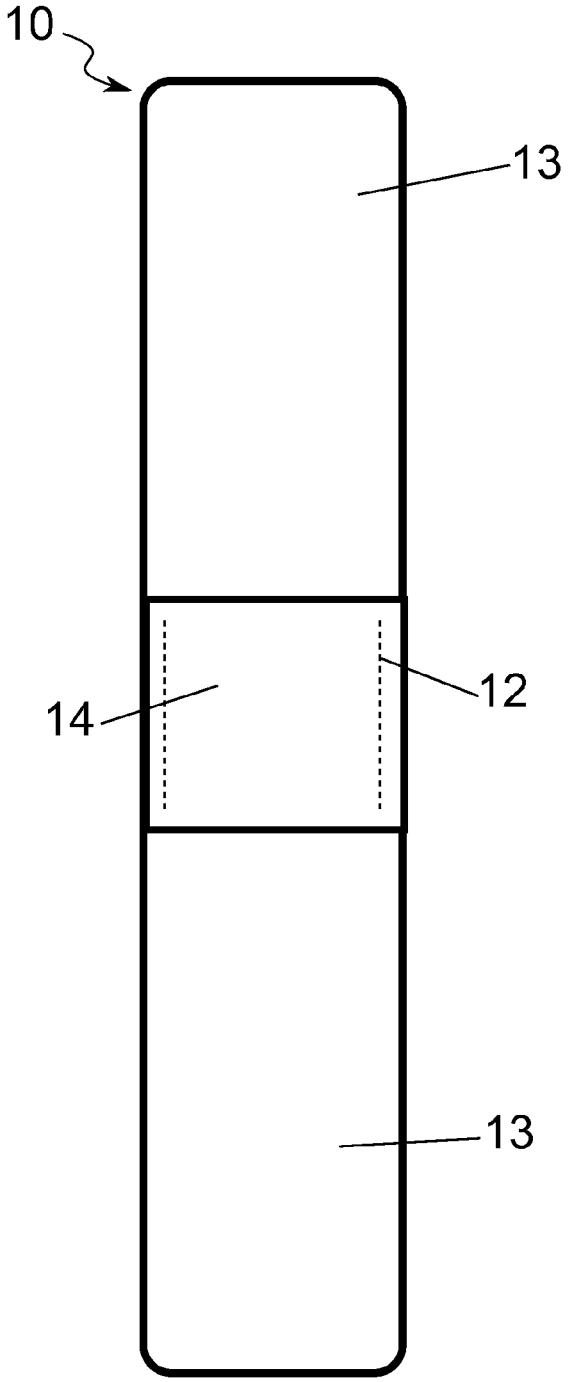
FIG. 1*b* shows the outside surface of the vertical orientation of the device for attaching an additional parcel to a rolling suitcase.

FIG. 1*b* shows the vertical orientation of device 10, this time showing the outside surface of the device. Stitching 12, parallel to the long edge of the device, secures sleeve 14 to the outside surface of device 10 as illustrated here. An extendible handle of a rolling suitcase or other comparable support mechanism slides through sleeve 14 such that device 10 can be wrapped around a parcel and secured thereto. Area 13 is receptive to a hook and loop fastening mechanism and is intended to be the area onto which strip 11 connects to secure device 10 around a parcel.

Figure 2A:
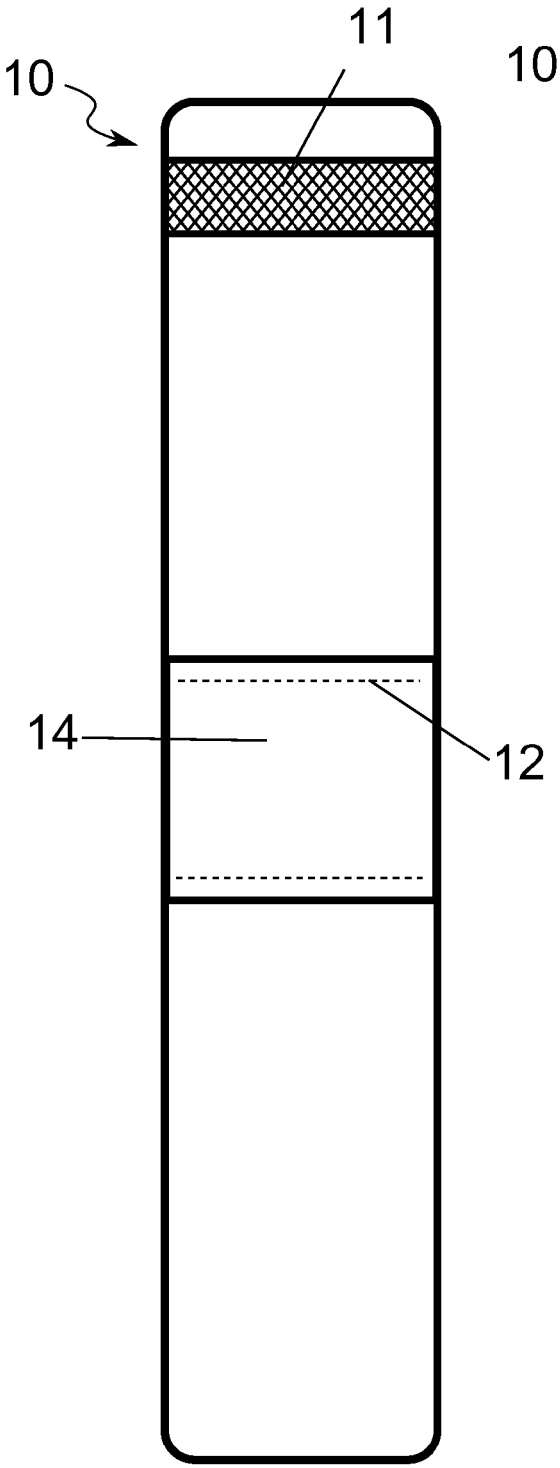
FIG. 2*a* shows the inside surface of the horizontal orientation of the device for attaching an additional parcel to a rolling suitcase.

FIG. 2*a* shows another embodiment of the invention, the horizontal orientation of device 10. Shown here is the inside surface of device 10, where stitching 12 is parallel the short edge of the device and is again used to secure sleeve 12 in place for mounting around the extendible handle of the rolling suitcase. In the horizontal orientation, placement of sleeve 14 on the inside surface of the strap mechanism provides more support for the device as a whole as less stress is placed on the stitching, grommets, or rivets used to secured sleeve 14.

Figure 2B:
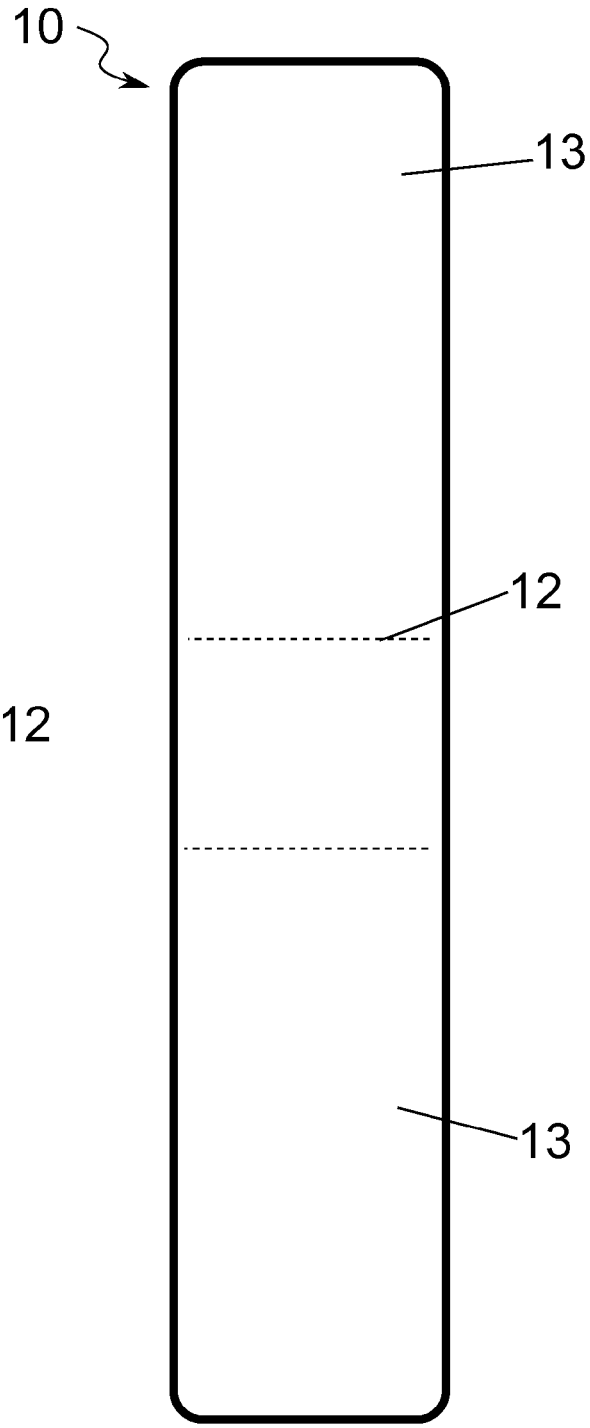
FIG. 2*b* shows the outside surface of the horizontal orientation of the device for attaching an additional parcel to a rolling suitcase.

FIG. 2*b* shows the horizontal orientation of device 10, showing the outside surface of the device. Stitching 12 is parallel to the short edge of the device. Area 13 is receptive to a hook and loop fastening mechanism and is intended to be the area onto which strip 11 connects to secure device 10 around a parcel.

Figure 3A:
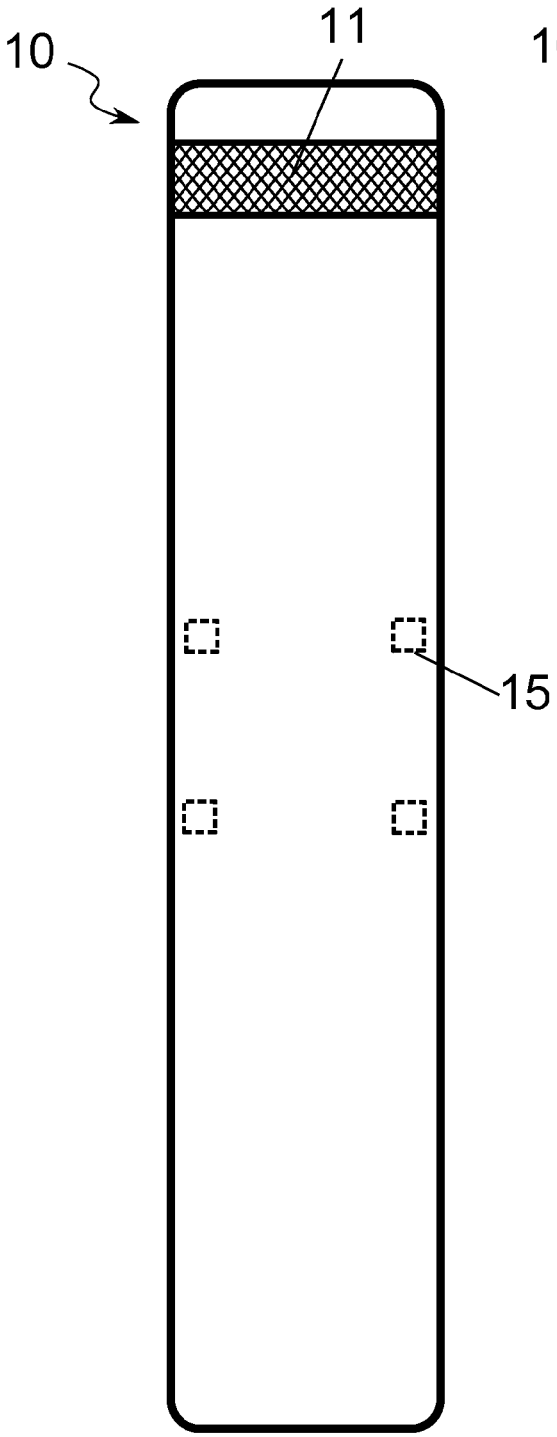
FIG. 3*a* shows the inside surface of a universal configuration of the device for attaching an additional parcel to a rolling suitcase, whereby the device can be used in either a horizontal or vertical orientation.

FIG. 3*a* shows one embodiment of the invention wherein reinforced stitching, grommets, rivets, or other comparable means 15 are used to secure sleeve 14 onto the inside surface of device 10 at the four corners of the connection point between sleeve 14 and the strap device 10. In this way, either a vertical or horizontal configuration of device 10 is possible as the extendible handle of the rolling suitcase can fit through either parallel to the long edge or parallel to the short edge of device 10. Strip 11 consists of a hook and loop fastening mechanism and is used to secure the device 10 around an additional parcel. Additional hook and loop fastening pieces can be placed at locations between the reinforced stitching, grommets, or rivets, either along the edge or in the center of sleeve 14. These additional fastening pieces would provide additional support for sleeve 14 and for device 10 overall.

Figure 3B:
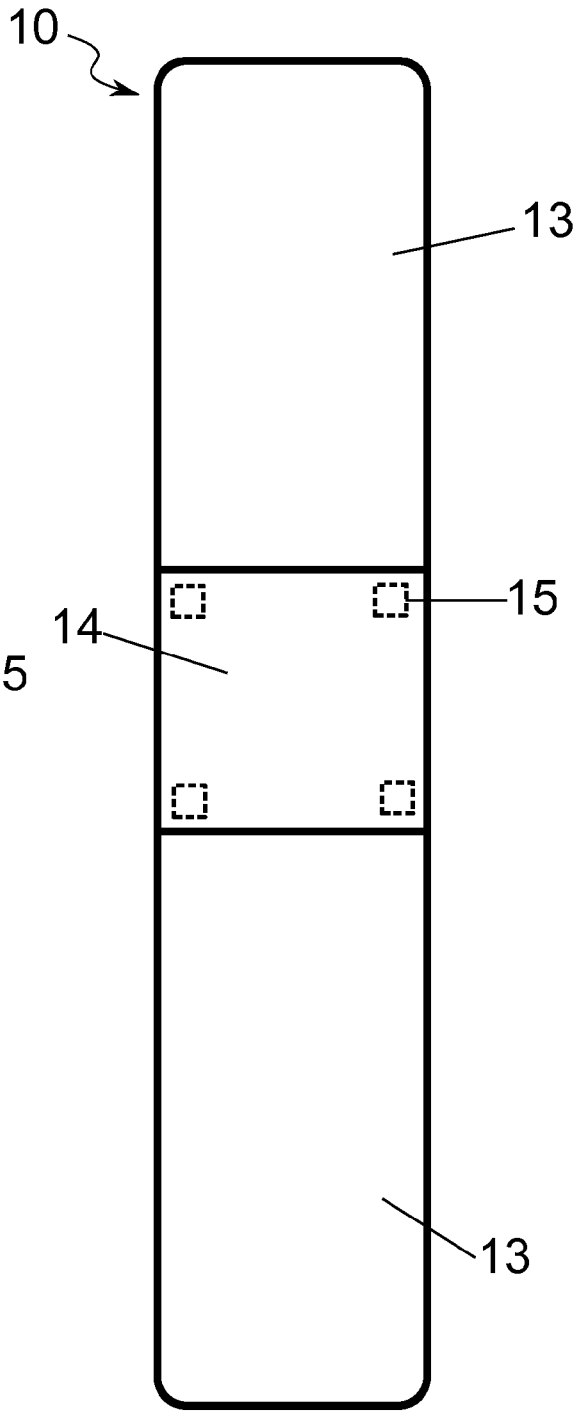
FIG. 3*b* shows the outside surface of a universal configuration of the device for attaching an additional parcel to a rolling suitcase, whereby the device can be used in either a horizontal or vertical orientation.

FIG. 3*b* illustrates the outside surface of device 10 including reinforced stitching, grommets, rivets, or other comparable means 15 which are used to secure sleeve 14 and hook and look receptive area 13.

Figures 3C, 3D:
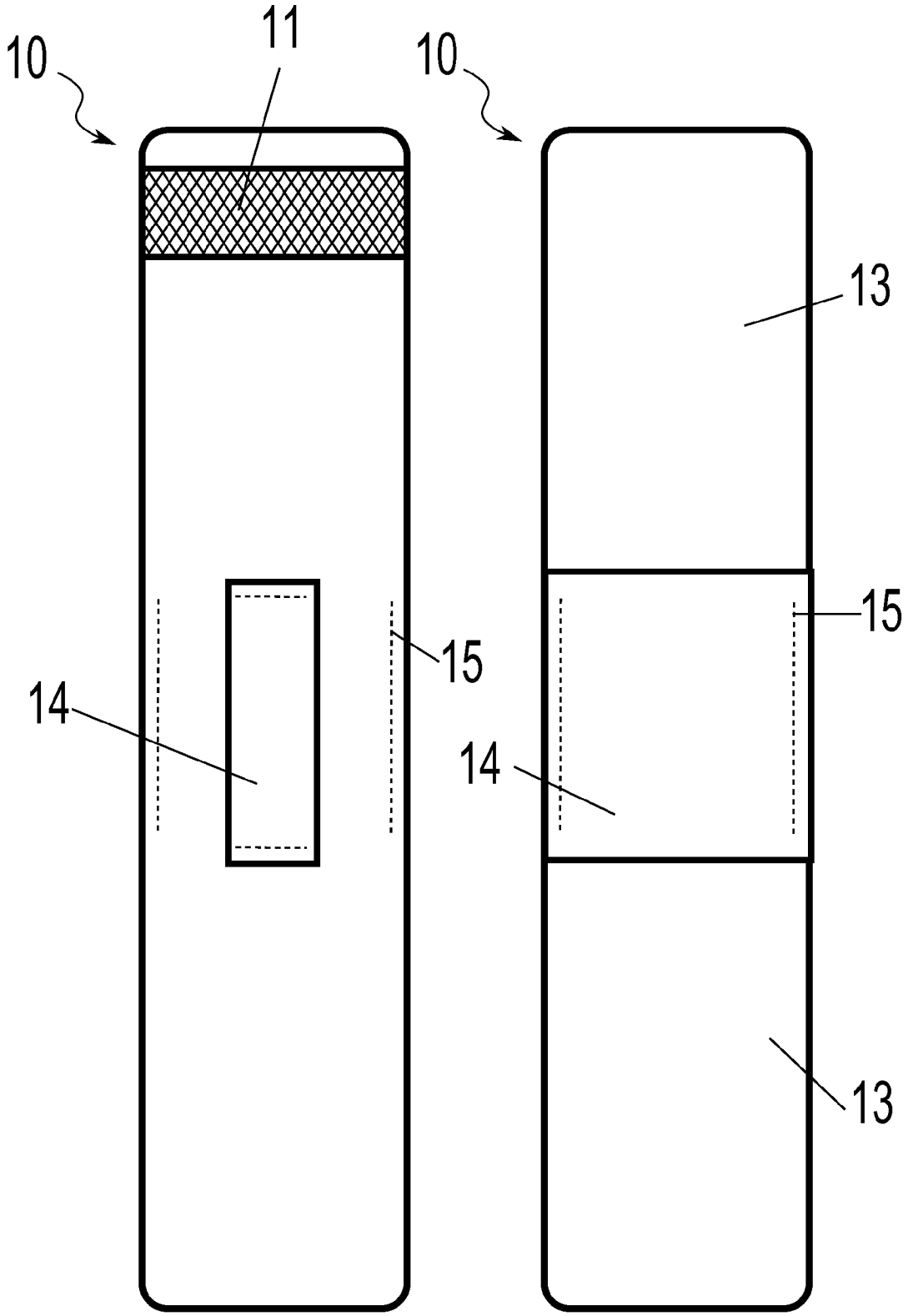
FIG. 3*c* shows the inside surface of an alternative form of the universal configuration of the device for attaching an additional parcel to a rolling suitcase, whereby the device can be used in either a horizontal or vertical orientation.
FIG. 3*d* shows the outside surface of an alternative form of the universal configuration of the device for attaching an additional parcel to a rolling suitcase, whereby the device can be used in either a horizontal or vertical orientation.

FIG. 3*c* and FIG. 3*d* illustrate the inside and outside surfaces, respectively, of a preferred embodiment of the universal configuration. Reinforced stitching is used as securing means for sleeve 14 on the outside surface along the long edge of the device 10 and as a securing means for sleeve 14 on the inside surface along the edge parallel with the short edge of the device 10. Additionally, pieces of hook and loop fastening mechanism strips may be attached to the surface of sleeve 14 (for sleeve 14 either on the inside or outside surface of device 10) in contact with hook and loop receptive area 13 to provide securing means for device 10 once in place around a parcel for transportation on top of a rolling suitcase 19. Strips of hook and loop fastening mechanism may be circular, square, rectangular, or any other reasonable shape.

In the preferred embodiment, sleeve 14 is placed on the outside surface of device 10. The width of the device may range from 4-12 inches, preferably 7-9 inches, and the length of the device may range from 36-60 inches, preferably 40-50 inches. The smaller range of sizes may be used for attachment apparatuses intended for use by children and with children's rolling suitcases. The mid to high end of sizes may be used by adults for medium and larger rolling luggage. Variations from these size ranges are possible and would be obvious to one of ordinary skill in the art.

Figure 4:
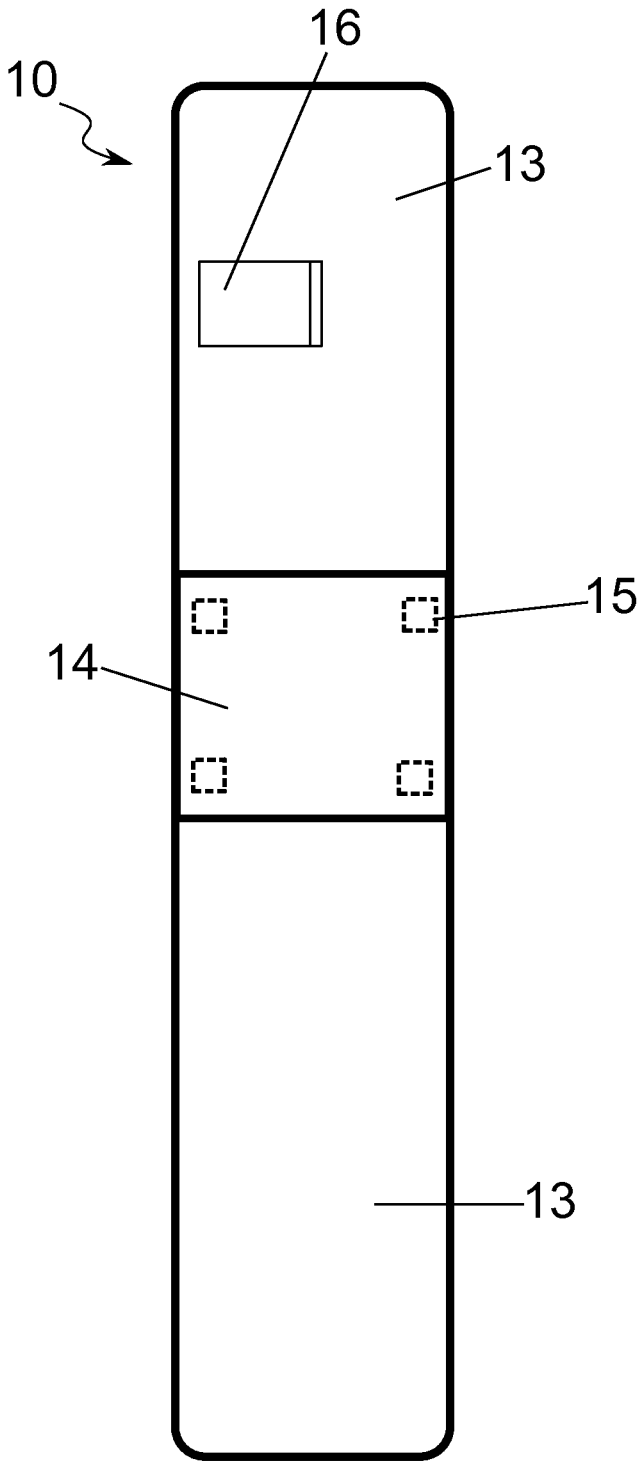
FIG. 4 is an alternate embodiment of the invention, indicating an extra pocket for storage of various items desired to be easy access during travel.

FIG. 4 shows an embodiment of the invention wherein pocket 16 is attached to the outside surface of device 10 for attaching a parcel to a rolling suitcase. Pocket 16 can be added to any configuration of the device, vertical, horizontal, or the universal configuration. Pocket 16 can be used to conveniently hold anything from a cell phone, PDA, tablet, MP3 player, keys, pens or pencils, passports or other travel paperwork, or any other item of an appropriate size. The pocket or pockets, which can be placed anywhere along the length of the strap mechanism, can be attached by Velcro to be movable about the outside surface of the strap mechanism or attaching using stitching, rivets, grommets, or other attachment means obvious to one of ordinary skill in the art. Alternatively, loops, hooks or other devices obvious to one of ordinary skill in the art could be used in conjunction with the present invention.

Figure 5A:
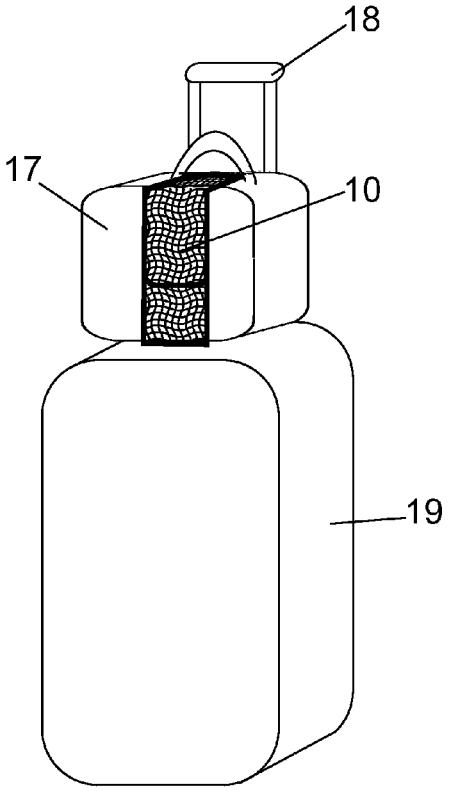
FIG. 5*a* shows the device in use in the vertical orientation securing a parcel (purse, carry-on bag, etc) on top of a rolling suitcase.

FIG. 5*a* shows parcel (purse, small travel bag, etc) 17 sitting on top of suitcase 19 adjacent to extendible handle 18 secured with device 10 using a hook and loop fastening mechanism to support parcel 17 from sliding or falling off if the user were to turn a sharp corner with the rolling suitcase.

The attachment device may be used to surround a medium size tote bag, for example, by wrapping the strap through the handles, which may provide extra support for the tote bag to help keep the contents secure. The sleeve of the attachment apparatus may be subsequently placed over a retractable handle of a rolling suitcase for transport and secured using a securing mechanism such as a hook and loop fastening mechanism. The tote bag may be easily removed from the top of the rolling suitcase during security check in, for example, simply by releasing any securing devices of the sleeve and lifting the tote bag with attachment apparatus strap surrounding to place onto the moving belt for security inspection. An additional benefit of the attachment apparatus is here provided in extra support for containing the contents of the tote bag.

Figure 5B:
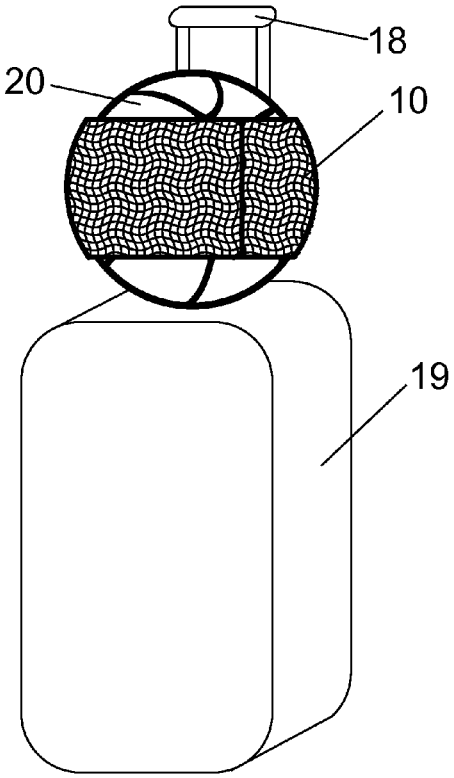
FIG. 5*b* shows a front view of the device in use securing a basketball on top of a rolling suitcase.

FIG. 5*b* shows a front view of basketball 20 sitting on top of suitcase 19 adjacent to extendible handle 18 secured with device 10 using a hook and loop fastening mechanism to support parcel 17 from sliding or falling off if the user were to turn a sharp corner with the rolling suitcase. This illustration is used to show the universality of the parcel that could be placed on top of suitcase 19.

Figure 5C:
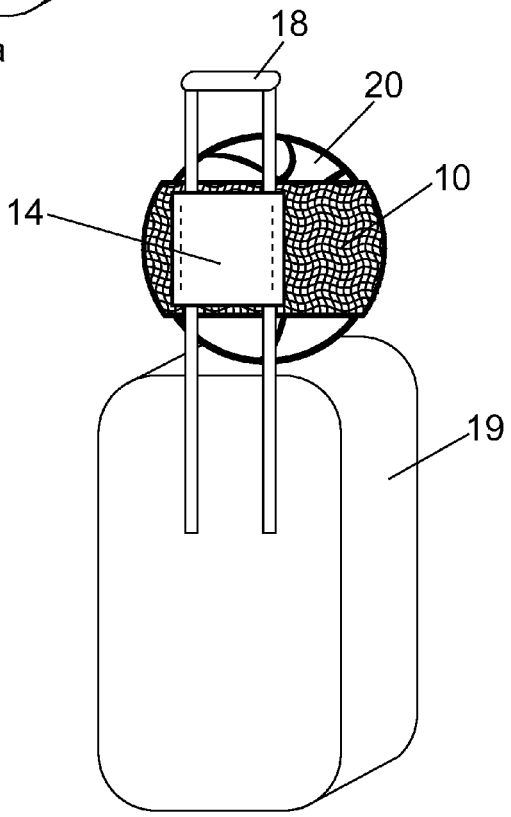
FIG. 5*c* shows a rear view of the device in use in the universal configuration, securing a basketball on top of a rolling suitcase.

FIG. 5*c* shows a rear view of basketball 20 sitting on top of suitcase 19 with the universal configuration of strap mechanism 10. Sleeve 14 is located on the outside surface of device 10.

It should be understood that the foregoing description is only illustrative of the invention. Various alternatives and modifications can be devised by those skilled in the art without departing from the invention. Accordingly, the present invention is intended to embrace all such alternatives, modifications, and variances which fall within the scope of the invention.

The invention claimed is:

1. An attachment apparatus comprising:

a strap to surround a parcel;

a first sleeve for sliding the apparatus over a retractable handle of a rolling suitcase;

a second sleeve for sliding the apparatus over a retractable handle of a rolling suitcase; and a first securing device for securing the strap around the parcel;

wherein engagement of the attachment apparatus with the parcel on top of a rolling suitcase limits motion of the parcel during movement of the rolling suitcase; wherein attachment of the attachment apparatus to the rolling suitcase with the first sleeve orients the strap in a horizontal orientation and attachment of the attachment apparatus to the rolling suitcase with the second sleeve orients the strap in a vertical orientation.

2. The attachment apparatus of claim 1, wherein the first sleeve and the second sleeve are attached to the strap using a reinforcement mechanism.

3. The attachment apparatus of claim 1, wherein the first securing device is a hook and loop fastening mechanism.

4. The attachment apparatus of claim 1, further comprising a second securing device for securing the first sleeve, the second sleeve, or both of the attachment apparatus to the retractable handle of the rolling suitcase.

5. The attachment apparatus of claim 2, wherein the reinforcement mechanism is selected from one of the following: reinforced stitching, grommets, or rivets.

6. The attachment apparatus of claim 1, wherein the strap comprises a stretchable material.

7. The attachment apparatus of claim 6, wherein the stretchable material is selected from one of the following: neoprene, veltex, elastic, medical grade elastic, neck-bonded laminate (NBL), stretch bonded laminate (SBL), or stretch jean material.

8. The attachment apparatus of claim 1, further comprising a storage pocket.

9. The attachment apparatus of claim 8, wherein the storage pocket is located on an outside surface of the attachment apparatus when the attachment apparatus is engaged around the parcel.

10. The attachment apparatus of claim 8, where the storage pocket is detachable.

11. The attachment apparatus of claim 1, where a length dimension of the strap is in the range of 36-60 inches.

12. The attachment apparatus of claim 1, were a width dimension of the strap is in the range of 4-12 inches.

* * * * *